United States Patent [19]

Kopco et al.

[11] Patent Number: 4,800,614

[45] Date of Patent: Jan. 31, 1989

[54] ADAPTOR AND BAG INSERT

[75] Inventors: James J. Kopco, Richmond Heights; John F. Sovis, Twinsburg, both of Ohio

[73] Assignee: Royal Appliance Mfg. Co., Cleveland, Ohio

[21] Appl. No.: 44,797

[22] Filed: Apr. 30, 1987

[51] Int. Cl.[4] ..... A47L 5/24

[52] U.S. Cl. ..... 15/330; 15/344; 15/347; 55/378

[58] Field of Search ..... 15/330, 344, 347, 352; 55/378, 379, 380

[56] References Cited

U.S. PATENT DOCUMENTS

| | | | |
|---|---|---|---|
| 1,182,404 | 5/1916 | Noguchi | 55/378 |
| 2,418,371 | 4/1947 | Smellie | 15/347 |
| 2,729,303 | 1/1956 | McMahan | 15/344 |
| 3,142,857 | 8/1964 | Fresard et al. | 15/330 |
| 3,392,906 | 7/1968 | Fesco | 55/378 |
| 3,466,696 | 4/1969 | Greusson | 15/330 |
| 4,175,352 | 11/1979 | Catlett | 15/344 |
| 4,209,875 | 7/1980 | Pugh et al. | 15/347 |
| 4,674,146 | 6/1987 | Tuggle et al. | 15/330 |

*Primary Examiner*—Harvey C. Hornsby
*Assistant Examiner*—Corinne M. Reinckens
*Attorney, Agent, or Firm*—Fay, Sharpe, Beall, Fagan, Minnich McKee

[57] ABSTRACT

A disposable bag filters dirt particles and the like from exhaust air of a hand-held vacuum cleaner. The motor housing of the vacuum cleaner receives a conventional reusable bag thereon and an adaptor facilitates change-over of existing vacuum cleaners to accommodate the disposable bag. A reinforcing member is provided on the disposable bag and is dimensioned for a friction fit with the adaptor. Another preferred embodiment incorporates a seal member into the assembly to enhance the sealing integrity between the adaptor and disposable bag.

6 Claims, 3 Drawing Sheets

ADAPTOR AND BAG INSERT

BACKGROUND OF THE INVENTION

This invention pertains to the art of vacuum cleaners and more particularly to hand-held vacuum cleaners and the like.

The invention is particularly applicable to converting an existing single bag vacuum cleaner to a dual bag arrangement and will be described with particular reference thereto. However, it will be appreciated that the invention has broader applications and may be advantageously employed in other environments and applications.

A prior art hand-held vacuum cleaner includes a motor housing encompassing a conventional rotary motor which defines suction means for removing dirt and debris from a surface. A nozzle housing extends integrally from the motor housing to facilitate vacuuming the surface. According to one type of prior structure, a beater brush is operatively disposed in the nozzle housing to provide a mechanical sweeping action that works in conjunction with the suction means. A handle is commonly formed as an integral extension of the motor housing and includes a power switch for selectively supplying electrical current to the motor. A flexible fabric or cloth bag is sealingly secured to an end of the motor housing disposed away from the nozzle housing and designed to receive dirt, debris, and the like picked up by the suction means. An elastic retaining ring sealingly secures the flexible bag to the motor housing.

Prior art structures of this type have met with tremendous commercial success. Once the flexible bag has substantially filled with dirt, the retaining ring may be selectively removed from the motor housing so that the flexible bag can be emptied. Although designed for continued use and durable wear, the flexible bag does retain a certain amount of fine particles or dirt after extended use. In an effort to eliminate some of this retained dirt, it has been considered desirable to incorporate a second, disposable filter bag into the assembly. This arrangement necessarily requires a changeover in the present structure to incorporate a second, disposable bag therein.

An important feature of the incorporation of a second, disposable bag is the ability to facilitate changeover of existing hand-held vacuum cleaners. Thus, it is necessary that the second bag should not radically alter the arrangement of existing component parts. Further, prior art vacuum cleaners that have employed dual bags are normally associated with the larger floor model. Special designs are required in these floor models to accommodate a disposable filter bag. More specifically, the filter bags are clipped on or employ an elastic retaining ring in an effort to sealingly secure the disposable filter bags to the outlet.

The subject invention is deemed to meet these needs and overcome the above-noted problems and others while economically adapting present hand-held vacuum cleaner structures with a disposable filter bag.

SUMMARY OF THE INVENTION

The present invention contemplates a new and improved hand-held vacuum cleaner that allows easy changeover from existing models and facilitates disposal of dirt and debris.

According to one aspect of the invention, the hand-held vacuum cleaner includes a first, removable bag sealingly engaged to a motor housing in covering relation with an outlet passage. A second, disposable bag is received in the first bag. A reinforcing member is associated with the second bag in covering relation with the outlet. A seal member engages the reinforcing member along one face thereof and operatively cooperates with a tapered outlet portion of an adaptor communicating with the outlet passage. The adaptor tapered portion frictionally engages the seal member as the sole means of interconnection between the second bag and the adaptor.

According to a more limited aspect of the invention, means for securing the adaptor to the housing is provided.

According to yet another aspect of the invention, the seal member partially extends into an interior cavity of the second bag.

A principal advantage of the invention is the facilitated changeover of existing models to a second, disposable bag insert and the ability to accommodate a blower attachment.

Yet another advantage of the invention resides in the disposability of a dirt laden bag.

Still another advantage of the invention is found in the simplified construction.

Still other advantages and benefits of the invention will become apparent to those skilled in the art upon a reading and understanding of the following detailed description.

BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

DETAILED DESCRIPTION OF THE PREFERRED EMBODIMENT

Figure 1:
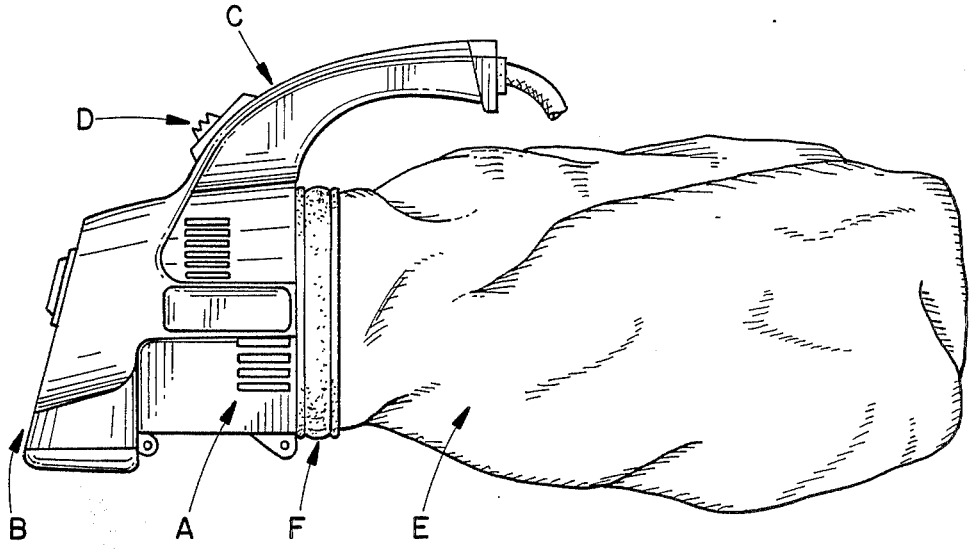
FIG. 1 (PRIOR ART)
FIG. 1 is a side elevational view of a conventional, hand-held vacuum cleaner.

Referring now to the drawings, wherein the showings are for purposes of illustrating the preferred embodiment of the invention only and not for purposes of limiting same, FIG. 1 shows a prior art motor housing A having a nozzle housing B extending integrally therefrom. A rotary motor (not shown) creates a suction effect at the nozzle housing which, when coupled with a rotary beater brush (not shown), removes dirt, debris, and the like from an associated surface. A handle C extends outwardly from the motor housing to facilitate gripping by an operator. The handle also serves the dual function of directing a power cord from the motor housing and receiving a power switch D thereon to selectively actuate the rotary motor. A flexible, reusable bag E is disposed on a rear portion of the motor housing at an area opposite the nozzle housing. Dirt-laden working air exiting the rotary motor is channeled to the flexible bag. The bag filters the dirt and debris from the working air. The bag may then be periodically removed from the motor housing for emptying. An elastic ring F retains the filter bag in sealing engagement with the motor housing so that the dirt-laden air is forced to filter through the flexible bag.

Figure 3:
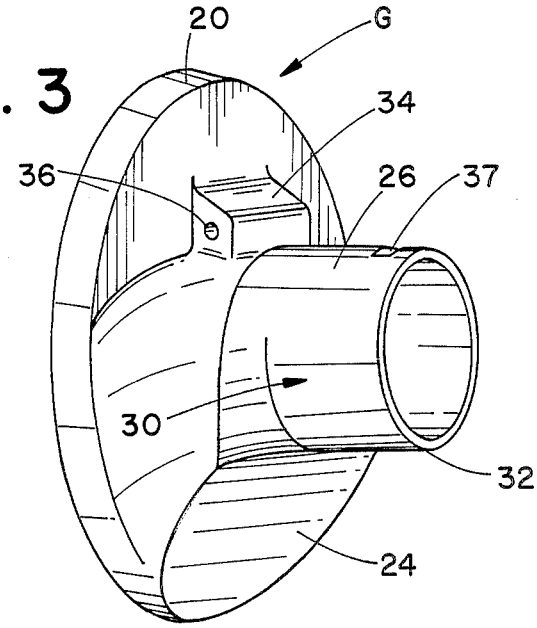
FIG. 3 is a perspective view of the adaptor of the subject invention.
Figure 2:
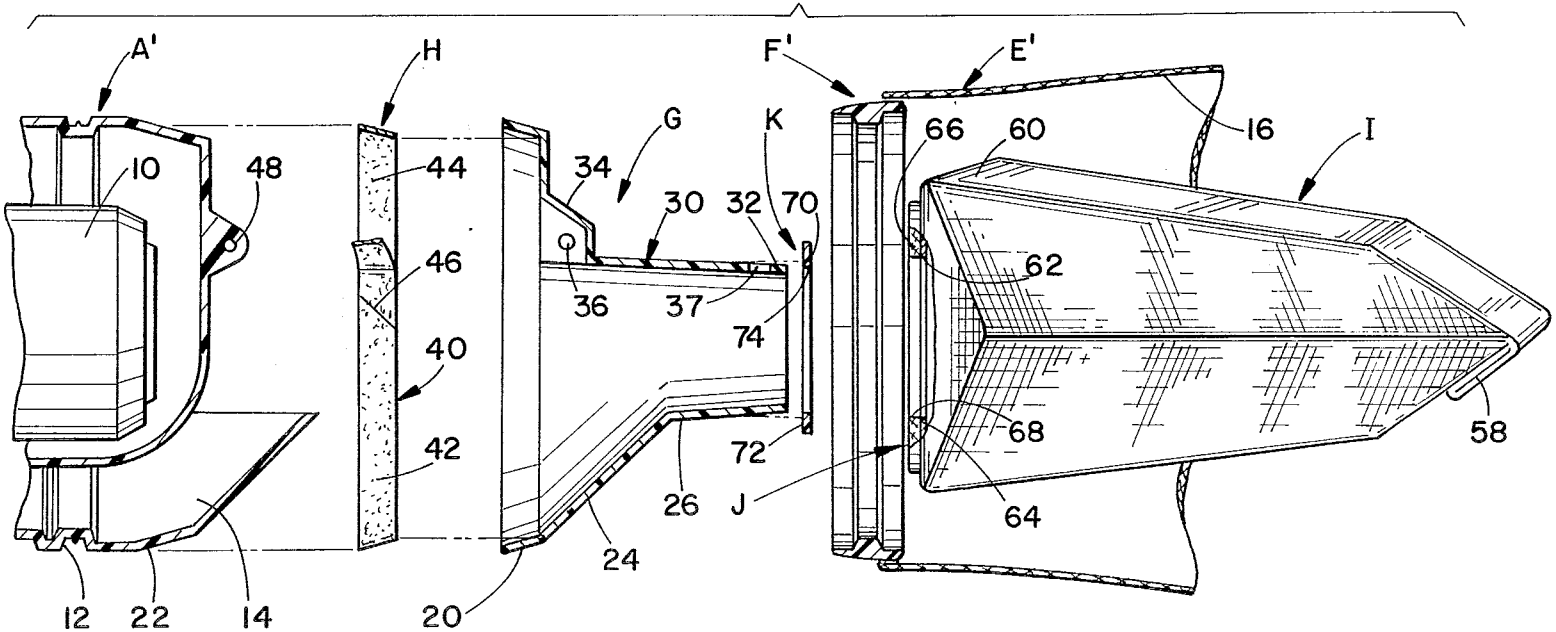
FIG. 2 is an exploded, vertical cross-sectional view of a modified hand-held vacuum cleaner formed in accordance with the subject invention.

Turning now to FIGS. 2 and 3, the subject invention will be described in detail. For ease of illustration, like elements are identified by like letters with a primed suffix (') and new elements are identified by new letters and numerals. The motor housing A' receives an adaptor G in surrounding relation with an air outlet. Means for securing the adaptor to the motor housing gasket H is also utilized. The adaptor is disposed between the motor housing and flexible bag E', which is held thereon by elastic ring F'. A second, disposable bag I cooperates with a reinforcing member J and gasket or seal means K. For ease of illustration and discussion, the seal means K is shown as a separate member from the disposable bag I although it will be understood that the seal means could be formed as an integral portion of the disposable bag without departing from the scope and intent of the subject invention.

More specifically, the motor housing A' includes a motor 10 for rotatably driving an impeller or rotary blade (not shown) and, simultaneously, providing a rotary motion to the revolving brush disposed in the nozzle housing at a forward end of the motor housing. Rotation of the impeller creates a vacuum or suction effect and, in conjunction with the rotary motion of the brush, removes dirt and debris from a surface. The present embodiment contemplates a vacuum cleaner that is generally hand-held and designed for sweeping countertops, tables, car interiors, and the like where the lightweight housing is highly adaptable to the vacuuming arrangement.

The motor housing includes a recessed area 12 adapted to receive the elastic or flexible retainer ring F' which secures the reusable cloth bag E' to the housing. An exhaust outlet 14 is defined along a peripheral portion of the motor housing to direct dirt-laden air into the cavity 16 defined by the interior of the flexible cloth bag E'.

In accordance with the subject invention, the adaptor G includes a first tapered rim portion 20 adapted to conform to the tapering peripheral surface area 22 of the motor housing. The rim portion 20 is of short axial length and defines a wide diameter end of the adaptor. A steeply sloping portion 24 extends radially inward from the rim portion 20 toward a generally tubular portion 26 defined at the opposed end of the adaptor. The steep sloping portion 24 only extends peripherally around a portion of the adaptor (FIG. 3). As is apparent in FIG. 2, the steeply sloped portion is designed to advantageously accommodate the exhaust outlet which has a mating, steeply sloped region.

The tubular portion 26 has a generally tapered periphery defining a wide diameter region 30 adjacent the sloping portion 24. A narrow diameter region 32 is defined at the axially outermost portion of the adaptor for receipt of the second, disposable bag I. The narrow diameter region 32 facilitates assembly of the disposable bag on the adaptor. The adaptor also includes a flange 34 axially interposed between the rim portion 20 and the tubular portion 26. The flange 34 completes the circumferential region of the adaptor periphery that is dominated by the sloping portion 24. The flange includes an aperture 36 designed to receive a fastener such as a screw or the like (not shown) for engagement with the motor housing.

Figure 4:
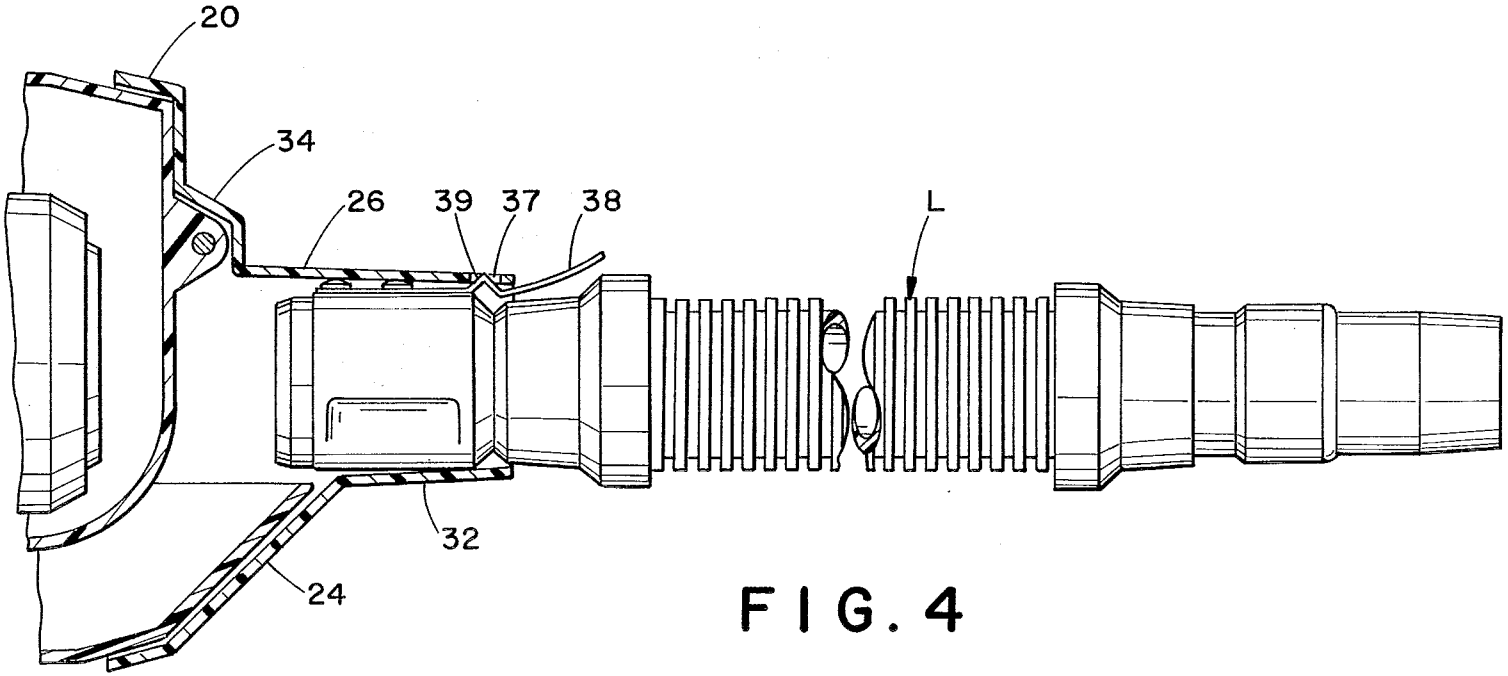
FIG. 4 is a side elevational view of a blower attachment illustrating connection with the modified hand-held vacuum cleaner of the subject invention.

The adaptor also includes a slot 37 adapted to receive a blower attachment L as particularly illustrated in FIG. 4. An outwardly biased spring clip 38 is typically used on one end of the blower attachment to facilitate selective locking engagement with the adaptor. More specifically, the tubular portion 26 is dimensioned to axially receive the one end of the blower attachment. The spring clip 38 includes a bent portion 39 that extends into the slot and prevents axial removal of the blower attachment once it is inserted in the adaptor. The exhaust air from the hand held vacuum cleaner is thereby provided to the outer end of the blower attachment for use in a conventional manner. Further description of the blower attachment is deemed unnecessary since it fomrs no part of the subject invention.

A double-sided adhesive tape 40 includes a first outer surface 42 and a second inner surface 44. The tape 40 is shown in broken fashion in FIG. 2 in order to clearly illustrate its construction. Preferably, a slit or break 46 is defined in the tape to facilitate placement of the tape into the adaptor. The outer surface 42 is received in the tapered rim portion 20 of the adaptor. Any conventional adhesive material may be used on the outer surface 42 of the tape to securely attach the tape to the adaptor. Likewise, a suitable adhesive material is provided on the inner surface 44 of the tape for secure attachment to the tapered peripheral portion 42 of the motor housing.

The cooperating tapered surfaces of the adaptor and exhaust outlet coupled with the double-sided adhesive tape define the attaching means of the subject invention. This arrangement offers the benefit of a sealing gasket engagement between the adaptor and motor housing that is not achieved through use of a simplified, mechanical connection. Still other attaching means may be utilized without departing from the scope and intent of the subject invention. In the preferred embodiment, the adhesive tape cooperates with a fastener supplied through aperture 36 which, in turn, cooperates with aperture 48 on the housing. This provides an additional mechanical locking of the adaptor to the motor housing.

The second, disposable bag I is typically formed of a paper-like material. The disposable bag is of generally closed conformation having a first, foldsealed end 58 and a second, open end 60. The second end 60 includes an opening 62 defined therethrough to provide communication to the interior of the disposable bag. The opening 62 has a first dimension that closely corresponds to the outer diameter of the tubular portion 26 of the adaptor. The paper-like material from which the disposable bag is formed filters the dirt-laden working air from outlet 14 of the motor housing.

The reinforcing member J is of generally planar construction and designed for structural support of the second end of the disposable bag. Opposed faces 64, 66 cooperate with the disposable bag and adaptor, respectively. The reinforcing member may be secured to the bag in a conventional manner. As is apparent in FIG. 2, the reinforcing member has a central through opening 68 having a second dimension closely approximating the first dimension of the disposable bag opening 62. These openings are aligned in generally concentric relationship. In this manner, when the disposable bag is friction fitted with the outer diameter of the tubular portion 26 of the adaptor, slight deformation of the reinforcing member and disposable bag takes place around their respective openings. The reinforcing member prevents or limits any tearing during the friction fitting process.

Although the bag and reinforcing member are friction fitted to the outer diameter of the tubular portion 26, according to another preferred embodiment, use is also made of the gasket or seal means K. The seal means is of generally annular configuration having opposed surfaces 70 and 72. A central opening 74 therein has a third dimension substantially less than the first and second dimensions of the disposable bag and reinforcing member openings, respectively. Due to these dimensional relationships, an inner diameter portion of the seal means extends axially inward into the openings defined in the reinforcing member and disposable bag. The friction fit, sealing contact made with the outer diameter of the tubular portion is enhanced through use of the seal means. Once again, only a friction fit is required and no exterior structure is required to secure the disposable bag to the adaptor.

Once the adaptor, the motor housing, the disposable bag and, alternately, the seal means are fit together, the reusable flexible bag E′ can be secured to the motor housing by means of retaining ring F′. The flexible bag E′ is thereby disposed in generally concentric relation with the second, disposable bag. The flexible bag E′ is sealingly connected to the motor housing through the retainer ring while the second, disposable bag is sealingly connected by the adaptor to the motor housing.

Once sufficient debris has collected in the disposable bag, the cloth bag E′ is removed from the motor housing. The disposable bag I is then axially slid away from its friction fit connection with the tubular portion 26 of the adaptor and discarded. In this manner, a simplified method of collecting and removing debris from the vacuum cleaner is provided.

The invention has been described with reference to the preferred embodiments. Obviously modifications and alterations will occur to others upon a reading and understanding of this specification. It is intended to include all such modifications and alterations insofar as they come within the scope of the appended claims or the equivalents thereof.

Having thus described the invention, it is now claimed:

1. A hand-held vacuum cleaner comprising: a housing having suction means defined therein;

an adaptor having a passage defined therethrough an operatively connected to said housing, said adaptor having an inner end including a rim portion having a minimized axial dimension relative to a total axial dimension of the adaptor, a steeply sloping portion extending radially inward from the rim portion toward a generally tubular portion defined at an outer terminal end of the adaptor axially spaced from said inner end, said sloping portion extending only partially around the periphery of the adaptor, a connecting flange completing the periphery of the adaptor between the rim portion and generally tubular portion and an exterior surface of said generally tubular portion radially increasing from a narrow dimension adjacent the outer terminal end to a wide dimension adjacent the sloping portion;

a first, resuable bag selectively engaging said housing and adapted for covering relation with said adaptor;

a second, disposable bag selectively engaging said adaptor for filtering dirt particles and the like from exhaust air exiting from said suction means; and, a double-sided adhesive tape disposed on an interior portion of said rim portion facilitating connection between said adaptor and housing.

2. The hand-held vacuum cleaner as defined in claim 1 wherein said second bag includes a generally closed bag portion having an opening of first dimension defined through one end thereof, a reinforcing member having first and second opposed faces with an opening of second dimension extending therethrough, said second dimension closely approximating said first dimension and said reinforcing member having said first face in generally facing relation to said bag portion one end whereby said reinforcing member closely surrounds said bag portion opening and said reinforcing member opening second dimension being less than said adaptor tubular portion wide dimension whereby said second bag is friction fitted to the adaptor.

3. The hand-held vacuum cleaner as defined in claim 2 further comprising a seal member cooperating with said second bag to enhance a sealing relation between said adaptor and second bag.

4. The hand-held vacuum cleaner as defined in claim 3 wherein said seal member has an opening extending therethrough having a third dimension, said third dimension being less than said first and second dimensions whereby said seal member extends axially along a peripheral portion of said adaptor and is received through said second bag opening and reinforcing member opening.

5. The hand-held vacuum cleaner as defined in claim 1 wherein said adaptor includes means for selectively engaging an associated blower attachment whereby said hand-held vacuum cleaner may be used as a blower.

6. The hand-held vacuum cleaner as defined in claim 1 further comprising an aperture in said connecting flange adapted to receive a mechanical fastener for connecting said adaptor to the housing

* * * * *